US007980326B2

(12) United States Patent
Tibbitts et al.

(10) Patent No.: US 7,980,326 B2
(45) Date of Patent: Jul. 19, 2011

(54) METHOD AND SYSTEM FOR CONTROLLING FORCE IN A DOWN-HOLE DRILLING OPERATION

(75) Inventors: Gordon A. Tibbitts, Murray, UT (US); Greg Galloway, Conroe, TX (US); Adrian Vuyk, Jr., Houston, TX (US); Thomas Alan Carlson, Baytown, TX (US)

(73) Assignee: PDTI Holdings, LLC, Houston, TX (US)

( * ) Notice: Subject to any disclaimer, the term of this patent is extended or adjusted under 35 U.S.C. 154(b) by 341 days.

(21) Appl. No.: 12/271,514

(22) Filed: Nov. 14, 2008

(65) Prior Publication Data

US 2009/0126994 A1 May 21, 2009

Related U.S. Application Data

(60) Provisional application No. 60/988,295, filed on Nov. 15, 2007.

(51) Int. Cl.
*E21B 19/08* (2006.01)

(52) U.S. Cl. ..... 175/27; 175/38

(58) Field of Classification Search ..... 175/67, 175/424, 27, 38

See application file for complete search history.

(56) References Cited

U.S. PATENT DOCUMENTS

| | | | |
|---|---|---|---|
| 2,626,779 | A | 1/1953 | Armentrout |
| 2,724,574 | A | 11/1955 | Ledgervvood, Jr. |
| 2,727,727 | A | 12/1955 | Williams |
| 2,728,557 | A | 12/1955 | McNatt |
| 2,761,651 | A | 9/1956 | Ledgerwood, Jr. |
| 2,771,141 | A | 11/1956 | Lewis |
| 2,779,571 | A | 1/1957 | Ortloff |
| 2,807,442 | A | 9/1957 | Ledgerwood, Jr. |
| 2,809,013 | A | 10/1957 | Ledgerwood, Jr. et al. |
| 2,815,931 | A | 12/1957 | Williams |
| 2,841,365 | A | 7/1958 | Ramsey et al. |
| 2,868,509 | A | 1/1959 | VVilliams |
| 2,954,122 | A | 9/1960 | Colburn |
| 3,001,652 | A | 9/1961 | Schroeder et al. |
| 3,055,442 | A | 9/1962 | Prince |
| 3,084,752 | A | 4/1963 | Tiraspolsky |
| 3,093,420 | A | 6/1963 | Levene et al. |

(Continued)

FOREIGN PATENT DOCUMENTS

CA 2522568 A1 11/2004

(Continued)

OTHER PUBLICATIONS

*Curlett Family Limited Partnership, Ltd.*, Plaintiff v. *Particle Drilling Technologies, Inc.*, a Delaware Corporation; and Particle Drilling Technologies, Inc., a Nevada Corporation; Affidavit of Harry (Hal B. Curlett); May 3, 2006; 8 pages.

(Continued)

*Primary Examiner* — Daniel P Stephenson
(74) *Attorney, Agent, or Firm* — Vedder Price P.C.

(57) ABSTRACT

A method and system of subterranean excavating that estimates a buoyancy force applied to a downhole excavating system from drilling fluid. The estimated buoyancy force is used to derive a true weight on bit (WOB) at the borehole bottom. The derived realized WOB is compared to a target WOB to obtain a change in WOB. Based on the change in WOB, the excavating system is adjusted so the realized WOB approximates the target WOB. The excavating system adjustment includes applying a compensating force to the string. Compensating forces can be produced by manipulating a block assembly or deploying a thruster device in the string.

29 Claims, 6 Drawing Sheets

U.S. PATENT DOCUMENTS

| | | | |
|---|---|---|---|
| 3,112,800 | A | 12/1963 | Bobo |
| 3,123,159 | A | 3/1964 | Buck |
| 3,132,852 | A | 5/1964 | Dolbear |
| 3,322,214 | A | 5/1967 | Buck |
| 3,374,341 | A | 3/1968 | Klotz |
| 3,380,475 | A | 4/1968 | Armstrong |
| 3,385,386 | A | 5/1968 | Goodwin et al. |
| 3,389,759 | A | 6/1968 | Mori et al. |
| 3,416,614 | A | 12/1968 | Goodwin et al. |
| 3,424,255 | A | 1/1969 | Mori et al. |
| 3,469,642 | A | 9/1969 | Goodwin et al. |
| 3,542,142 | A | 11/1970 | Hasiba et al. |
| 3,548,959 | A | 12/1970 | Hasiba et al. |
| 3,576,221 | A | 4/1971 | Hasiba |
| 3,645,346 | A | 2/1972 | Miller et al. |
| 3,667,557 | A | 6/1972 | Todd et al. |
| 3,688,852 | A | 9/1972 | Gaylord et al. |
| 3,688,859 | A | 9/1972 | Maurer |
| 3,704,966 | A | 12/1972 | Beck, Jr. |
| 3,831,753 | A | 8/1974 | Gaylord et al. |
| 3,838,742 | A | 10/1974 | Juvkam-Wold |
| 3,852,200 | A | 12/1974 | Meyer |
| 3,865,202 | A | 2/1975 | Takahashi et al. |
| 3,924,698 | A | 12/1975 | Juvkam-Wold |
| 4,042,048 | A | 8/1977 | Schwabe |
| 4,067,617 | A | 1/1978 | Bunnelle |
| 4,141,592 | A | 2/1979 | Lavon |
| 4,266,621 | A | 5/1981 | Brock |
| 4,304,609 | A | 12/1981 | Morris |
| 4,361,193 | A | 11/1982 | Graveley |
| 4,391,339 | A | 7/1983 | Johnson, Jr. et al. |
| 4,444,277 | A | 4/1984 | Lewis |
| 4,476,027 | A | 10/1984 | Fox |
| 4,490,078 | A | 12/1984 | Armstrong |
| 4,492,276 | A | 1/1985 | Kamp |
| 4,497,598 | A | 2/1985 | Blanton |
| 4,498,987 | A | 2/1985 | Inaba |
| 4,534,427 | A | 8/1985 | Wang et al. |
| 4,624,327 | A | 11/1986 | Reichman |
| 4,627,502 | A | 12/1986 | Dismukes |
| 4,681,264 | A | 7/1987 | Johnson |
| 4,699,548 | A | 10/1987 | Bergstrom |
| 4,768,709 | A | 9/1988 | Yie |
| 4,809,791 | A | 3/1989 | Hayatdavoudi |
| 4,825,963 | A | 5/1989 | Ruhle |
| 4,840,292 | A | 6/1989 | Harvey |
| 4,852,668 | A | 8/1989 | Dickinson, III et al. |
| 4,944,347 | A | 7/1990 | Richard et al. |
| 5,199,512 | A | 4/1993 | Curlett |
| 5,291,957 | A | 3/1994 | Curlett |
| 5,355,967 | A | 10/1994 | Mueller et al. |
| 5,421,420 | A | 6/1995 | Malone et al. |
| 5,542,486 | A | 8/1996 | Curlett |
| 5,718,298 | A | 2/1998 | Rusnak |
| 5,862,871 | A | 1/1999 | Curlett |
| 5,881,830 | A | 3/1999 | Cooley |
| 5,897,062 | A | 4/1999 | Enomoto et al. |
| 5,944,123 | A | 8/1999 | Johnson |
| 6,003,623 | A | 12/1999 | Miess |
| 6,142,248 | A | 11/2000 | Thigpen et al. |
| 6,152,356 | A | 11/2000 | Minden |
| 6,345,672 | B1 | 2/2002 | Dietzen |
| 6,347,675 | B1 | 2/2002 | Kolle |
| 6,386,300 | B1 | 5/2002 | Curlett et al. |
| 6,474,418 | B2 | 11/2002 | Miramon |
| 6,506,310 | B2 | 1/2003 | Kulbeth |
| 6,530,437 | B2 | 3/2003 | Maurer et al. |
| 6,533,946 | B2 | 3/2003 | Pullman |
| 6,571,700 | B2 | 6/2003 | Nakamura et al. |
| 6,581,700 | B2 | 6/2003 | Curlett et al. |
| 6,601,650 | B2 | 8/2003 | Sunararajan |
| 6,651,822 | B2 | 11/2003 | Alanis |
| 6,904,982 | B2 | 6/2005 | Judge et al. |
| 6,920,945 | B1 | 7/2005 | Belew et al. |
| 7,090,017 | B2 | 8/2006 | Justus et al. |
| 7,172,038 | B2 | 2/2007 | Terry et al. |
| 7,258,176 | B2 | 8/2007 | Tibbitts et al. |
| 7,343,987 | B2 | 3/2008 | Tibbitts |
| 7,383,896 | B2 | 6/2008 | Tibbitts |
| 7,398,838 | B2 | 7/2008 | Harder et al. |
| 7,398,839 | B2 | 7/2008 | Harder et al. |
| 7,503,407 | B2 | 3/2009 | Tibbitts |
| 7,757,786 | B2 | 7/2010 | Harder et al. |
| 7,793,741 | B2 | 9/2010 | Harder et al. |
| 7,798,249 | B2 | 9/2010 | Tibbitts |
| 2002/0011338 | A1 | 1/2002 | Maurer et al. |
| 2002/0134550 | A1 | 9/2002 | Leeson et al. |
| 2006/0011386 | A1 | 1/2006 | Tibbitts |
| 2006/0016622 | A1 | 1/2006 | Tibbitts |
| 2006/0016624 | A1 | 1/2006 | Tibbitts |
| 2006/0021798 | A1 | 2/2006 | Tibbitts |
| 2006/0027398 | A1 | 2/2006 | Harder et al. |
| 2006/0124304 | A1 | 6/2006 | Bloess et al. |
| 2006/0180350 | A1 | 8/2006 | Harder |
| 2006/0191717 | A1 | 8/2006 | Harder et al. |
| 2006/0191718 | A1 | 8/2006 | Harder et al. |
| 2008/0017417 | A1 | 1/2008 | Tibbits |
| 2008/0156545 | A1 | 7/2008 | Tibbitts |
| 2008/0210472 | A1 | 9/2008 | Tibbitts |
| 2008/0230275 | A1 | 9/2008 | Harder |
| 2009/0038856 | A1 | 2/2009 | Vuyk |
| 2009/0200080 | A1 | 8/2009 | Tibbitts |
| 2009/0200084 | A1 | 8/2009 | Vuyk |
| 2009/0205871 | A1 | 8/2009 | Tibbitts |
| 2009/0223718 | A1 | 9/2009 | Tibbitts |

FOREIGN PATENT DOCUMENTS

| | | | |
|---|---|---|---|
| CA | 2588170 | A1 | 5/2007 |
| EP | 0192016 | A1 | 8/1986 |
| GB | 2385346 | A | 8/2003 |
| GB | 2385346 | B | 9/2004 |
| IQ | 20055376 | | 11/2005 |
| WO | 0225053 | A1 | 3/2002 |
| WO | 0234653 | A | 5/2002 |
| WO | 0292956 | A | 11/2002 |
| WO | 2004094734 | A2 | 11/2004 |
| WO | 2004106693 | A2 | 12/2004 |
| WO | 200601997 | A3 | 2/2006 |
| WO | 2009009792 | | 1/2009 |
| WO | 2009049076 | A1 | 4/2009 |
| WO | 2009065107 | A1 | 5/2009 |
| WO | 2009099945 | A2 | 8/2009 |

OTHER PUBLICATIONS

Geddes et al. "Leveaging a New Enegy Soure to Enhance Heavy-Oil and Oil-Sands Production," Society of Petroleum Engineers, SPE/PS-CIM/CHOA 97781, 2005 (7 pages).
www.particledrilling.com, May 4, 2006.
Anderson, Arthur, "Global E&P Trends" Jul. 1999, (2 pages).
Cohen et al., "High-Pressure Jet Kerf Drilling Shows Significant Potential to Increase ROP", SPE 96557, Oct. 2005, pp. 1-8.
Eckel, et al., "Development and Testing of Jet Pump Pellet Impact Drill Bits," Petroleum Transactions, Aime, 1956, 1-10, vol. 207.
Fair, John, "Development of High-Pressure Abrasive-Jet Drilling", Journal of Petroleum Technology, Aug. 1981, pp. 1379-1388.
Galecki et al., "Steel Shot Entrained Ultra High Pressure Waterjet for Cutting and Drilling in Hard Rocks", pp. 371-388.
Killalea, Mike, High Pressure Drilling System Triples ROPS, Stymies Bit Wear, Drilling Technology, Mar.-Apr. 1989, pp. 10-12.
Kolle et al., "Laboratory and Field Testing of an Ultra-High-Pressure, Jet-Assisted Drilling System," SPE/IADC 22000, 1991, pp. 847-856.
Ledgerwood, L., "Efforts to Develop Improved Oilwell Drilling Methods," Petroleum Transactions, Aime, 1960, 61-74, vol. 219. cited by other.
Maurer, William, "Advanced Drilling Techniques," Chapter 5, pp. 19-27, Petroleum Publishing Co., Tulsa, OK. 1980.
Maurer, William, "Impact Crater Formation in Rock," Journal of Applied Physics, Jul. 1960, pp. 1247-1252, vol. 31, No. 7.
Maurer et al., "Deep Drilling Basic Research vol. 1—Summary Report," Gas Research Institute, GRI 90/0265.1, Jun. 1990.
Peterson et al., "A New Look a Bit-Flushing or the Importance of the Crushed Zone in Rock Drilling and Cutting," (20 pages).
Ripken et al., "A Study of the Fragmentation of Rock by Impingement with Water and Solid Impactors," University of Minnesota St. Anthony Falls Hydraulic Laboratory, Feb. 1972, 114 pages.

Review of Mechanical Bit/Rock Interactions, vol. 3, pp. 3-1 to 3-68. Security DBS, 1995, (62 pages).
Singh, Madan, "Rock Breakage by Pellet Impact," IIT Research Institute, Dec. 24, 1969 (92 pages).
Summers et al., "A Further Investigation of DIAjet Cutting," Jet Cutting Technology—Proceedings of the 10th International Conference, 1991, pp. 181-192; Elsevier Science Publishers Ltd, USA.
Summers, David, "Waterjetting Technology," Abrasive Waterjet Drilling, pp. 557-598, Curators' Professor of Mining Engineering and Director High Pressure Waterjet Laboratory University of Missouri-Rolla Missouri, E & FN SPON, London, UK, First Edition 1995 (ISBN 0 419 19660 9).
Veenhuizen, et al., "Ultra-High Pressure Jet Assist of Mechanical Drilling," SPE/IADC 37579, pp. 79-90, 1997.
International Search Report PCT/US04/11578; dated Dec. 28, 2004 (4 pages).
International Preliminary Report of Patentability PCT/US04/11578; dated Oct. 21, 2005 (5 pages).
Written Opinion PCT/US04/11578; dated Dec. 28, 2004 (4 pages).
Examination Report dated May 8, 2007 on GCC Patent No. GCC/P/2004/3505 (4 pages).
Co-pending U.S. Appl. No. 12/033,829, filed Feb. 19, 2008, Titled "Impact Excavation System and Method With Particle Separation".
Co-pending U.S. Appl. No. 12/120,763, filed May 15, 2008, Titled "Impact Excavation System and Method With Particle Separation".
Co-pending U.S. Appl. No. 12/122,374, filed May 16, 2008, Titled "Impact Excavation System and Method With Injection System".
U.S. Appl. No. 11/801,268, filed May 9, 2007, Tibbitts, co-pending application.
U.S. Appl. No. 11/773,355, filed Jul. 3, 2007, Vuyk, co-pending application.
U.S. Appl. No. 11/204,862, filed Aug. 16, 2005, Tibbitts, co-pending application.
U.S. Appl. No. 12/388,289, filed Feb. 1, 2006, Tibbitts, co-pending application.
U.S. Appl. No. 12/172,760, filed Jul. 14, 2008, Vuyk, Jr., co-pending application.
U.S. Appl. No. 12/363,022, filed Jan. 20, 2008, Tibbitts.
Behavior of Suspensions and Emulsion in Drilling Fluids, Nordic Rheology Society, Jun. 14-15, 2007.
Colby, RH., Viscoelasticity of Structured Fluids, Corporate Research Laboratories, Eastman Kodak Company, Rochester, New York.
Rheo-Plex Product Information Seet, Scomi, Oiltools, 2 pages.
Gelplex Product Information Sheet, Miswaco, 2 pages.
Drillplex Product Information Sheet, Miswaco, 2 pages.
Drillplex System Sucessfully Mills Casing Windows Offshore Egypt Performance Report, Miswaco, 2 pages.
Drillplex the Versatile Water-Base System With Exceptional Rheological Properties Designed to Lower Costs in a Wide Range of Wells Product Information Sheet, Miswaco, 6 pages.
International Search Report PCT/US05/25092; Dated Mar. 6, 2006.
Written Opinion PCT/US05/25092; Dated Mar. 6, 2006.
International Preliminary Report on Patentability dated Nov. 19, 2009 on PCT/US08/05955, 5 pages.
International Preliminary Report on Patentability dated Apr. 17, 2009 on PCT/US2009/032654, 7 pages.
International Search Report dated Dec. 30, 2009 on PCT/US2009/032654, 1 page.
File history of European Patent Application No. 04759869.3.
File history of European Patent Application No. 5771403.2.
File history of GCC Patent Application No. 2005/5376.
File history of Iraq Patent Application No. 98/2005.
File history of Norwegian Patent Application No. 20070997.
File history of Venezuelan Patent Application No. 1484-05.
File history of Canadian Patent Application No. 2,588,170.
File history of Canadian Patent Application No. 2,522,568.
File history of Iraq Patent Application No. 34/2004.
File history of Norwegian Patent Application No. 20055409.
File history of GCC Patent Application No. 2004/3659.
International Preliminary Report on Patentability dated Jan. 12, 2010 on PCT/US08/69972, 5 pages.
*Curlett Family Limited Partnership, Ltd.*, Plaintiff v. *Particle Drilling Technologies, Inc.*, a Delaware Corporation; and Particle Drilling Technologies, Inc., a Nevada Corporation; Affidavit of Harry (Hal B. Curlett); May 3, 2006, 8 pages.
Geddes et al., "Leveraging a New Energy Source to Enhance Heavy-Oil and Oil-Sands Production," Society of Petroleum Engineers, SPE/PS-CIM/CHOA 97781, 2005, 7 pages.
www.particledrilling.com, May 4, 2006, 75 pages.
Anderson, Arthur, "Global E&P Trends" Jul. 1999, 2 pages.
Cohen et ai, "High-Pressure Jet Kerf Drilling Shows Significant Potential to Increase Rap", SPE 96557, Oct. 2005, pp. 1-8.
Eckel, et al., "Development and Testing of Jet Pump Pellet Impact Drill Bits," Petroleum Transactions, Aime, 1956, 1-10, vol. 207, pp. 1-10.
Fair, John, "Development of High-Pressure Abrasive-Jet Drilling", Journal of Petroleum Technology, Aug. 1981, pp. 1379-1388.
Galecki et al., "Steel Shot Entrained Ultra High Pressure Waterjet for Cutting and Drilling in Hard Rocks", pp. 371-388.
Killalea, Mike, High Pressure Drilling System Triples ROPS, Stymies Bit Wear, Drilling Technology, Mar.-Apr. 1989, pp. 10-12.
Kolle et al., "Laboratory and Field Testing of an Ultra-High-Pressure, Jet-Assisted Drilling System," SPE/ADC 22000, 1991, pp. 847-856.
Ledgerwood, L., "Efforts to Develop Improved Oilwell Drilling Methods," Petroleum Transactions, Aime, 1960, vol. 219, pp. 61-74.
Maurer, William, "Advanced Drilling Techniques," Chapter 5, pp. 19-27, Petroleum Publishing Co., Tulsa, OK. 1980, 11 pages.
Maurer, William, "Impact Crater Formation in Rock," Journal of Applied Physics, Jul. 1960, vol. 31, No. 7, pp. 1247-1252.
Maurer et al., "Deep Drilling Basic Research vol. 1—Summary Report," Gas Research Institute, GRI 9010265.1, Jun. 1990, 59 pages.
Peterson et al., "A New Look at Bit-Flushing or the Importance of the Crushed Zone in Rock Drilling and Cutting," 20 pages.
Ripken et al., "A Study of the Fragmentation of Rock by Impingement with Water and Solid Impactors," University of Minnesota St. Anthony Falls Hydraulic Laboratory, Feb. 1972, 114 pages.
Review of Mechanical Bit/Rock Interactions, vol. 3, pp. 3-1 to 3-68. Security DBS, 1995, 62 pages.
Singh, Madan, "Rock Breakage by Pellet Impact," IIT Research Institute, Dec. 24, 1969, 92 pages.
Summers et al., "A Further Investigation of DIAjet Cutting," Jet Cutting Technology-Proceedings of the 10th International Conference, 1991, Elsevier Science Publishers Ltd, USA, pp. 181-192.
Summers, David, "Waterjetting Technology," Abrasive Waterjet Drilling, Curators' Professor of Mining Engineering and Director High Pressure Waterjet Laboratory University of Missouri-Rolla Missouri, E & FN SPON, London, UK, First Edition 1995 (ISBN 0419196609), pp. 557-598.
Veenhuizen, et al., "Ultra-High Pressure Jet Assist of Mechanical Drilling," SPE/IADC 37579, 1997, pp. 79-90.

METHOD AND SYSTEM FOR CONTROLLING FORCE IN A DOWN-HOLE DRILLING OPERATION

RELATED APPLICATIONS

This application claims priority to and the benefit of co-pending U.S. Provisional Application Ser. No. 60/988,295, filed Nov. 15, 2007, the full disclosure of which is hereby incorporated by reference herein.

BACKGROUND OF THE INVENTION

1. Field of the Invention

The present disclosure relates to the field of oil and gas exploration and production. More specifically, the present disclosure concerns a system and method for subterranean excavation for adjusting weight on bit based on monitoring wellbore fluid density changes.

2. Description of Related Art

Boreholes for producing hydrocarbons within a subterranean formation are generally formed by a drilling system employing a rotating bit on the lower end of a drill string. The drill string is suspended from a derrick which includes a stationary crown block assembly connected to a traveling block via a steel cable that allows movement between the two blocks. The drill string can be rotated by a top drive or Kelly above the borehole entrance. Drilling fluid is typically pumped through the drill string that then exits the drill bit and travels back to the surface in the annulus between the drill string and wellbore inner circumference. The drilling fluid maintains downhole pressure in the wellbore to prevent hydrocarbons from migrating out of the formation cools and lubricates the bit and drill string, cleans the bit and bottom hole, and lifts the cuttings from the borehole. The drilling bits are usually one of a roller cone bit or a fixed drag bit. Impactors have recently been developed for use in subterranean excavations. Conventionally impactors are injected into a pressurized circulation fluid to form a slurry. The slurry is then directed to a drill string, having a bit on its lower end, and discharged through nozzles on the bit to structurally alter the subterranean formation.

During excavation operations the drill bit applies an axial force to the formation, the axial force is typically referred to as weight on bit (WOB). The drill string is suspended by the block assembly. As the bit is lowered to the bottom of the hole, a portion of the drillstring's suspended load is transferred to compressional load. The compressional load is commonly referred to as the weight on bit (WOB). As the bit drills, the WOB is monitored by a weight on bit indicator at the surface and the drillstring is lowered to maintain compressional loading at the bit (or WOB) within predetermined limits. The WOB limits are dependent on a number of factors including: bit type, formation type and hardness, bottom hole assembly configuration, and desired results Additionally, adjusting the WOB may be necessary to maximize rate of penetration, especially when different formations are encountered. On the other hand, too much WOB can damage the bit, drill string, or other axial load bearing members.

SUMMARY OF THE INVENTION

Disclosed herein is a method of subterranean excavating wherein compensating forces are applied to a drill string to compensate for a buoyancy effect experienced by the drill string from the flow used while excavating. The method can also compensate for changes in buoyancy. In one embodiment a method of excavating involves providing an excavation system in a borehole. The excavation system can include a rig, a tubular string suspended in the borehole from the rig and held with a support force from the rig. An axial bore runs through the string, an excavating member on the end of the string, and a nozzle on the member in fluid communication with the string bore. The method may further include pumping a fluid into the string bore, so that when the fluid forms a flow through the string bore to the excavating member where it exits the nozzle and courses through an annulus formed between the borehole and the string. A target weight on bit (WOB) is identified and a realized WOB is estimated based on flow density. An an axial compensating force may be applied to the string so that the realized WOB is approximately the same as the target WOB.

Impactors may be added to the fluid to form a slurry in the flow, wherein the slurry density exceeds the fluid density. The impactors may be substantially spherical metallic members. The excavating member can be a drill bit, a mill, or a fishing tool. The estimated flow density can be based on a parameter such as, wellbore diameter, drill string diameter, drill string volume, wellbore annulus volume, hole depth, flow circulation rate, impactor injection rate, impactor return rate, impactor particle return time, impactors in the flow, debris in the flow, slurry rheological properties, recording time interval, recording time interval rate, flow density into/out of wellbore, impactor density, low gravity material volume and/or density, and combinations thereof. A correction factor can be used to calculate the realized WOB to account for movement of impactors in the flow, wherein impactor movement within the flow can change pressure in the borehole and thereby change realized WOB. The correction factor may be based on historical data collected from the borehole or data collected from another borehole. The buoyancy force applied to the excavation member by the flow can be calculated using, flow density, flow circulation rate, nozzle geometry, excavating rate of penetration, or combinations thereof. Optionally, realized WOB can be based on an estimated pressure in the flow. The applied compensating force to adjust WOB can be performed dynamically.

A controller may be included with the method to automate the steps of estimating WOB and adjusting to compensate for changes to the WOB. Manipulating a block assembly or deploying a compliant member in the string can be used to apply a compensating force. The applied force can compensate for an increase in estimated realized WOB as well as a decrease in estimated realized WOB.

Also described herein is an excavating system for excavating downhole. The excavating system may include an excavating rig, a string deployable downhole coupled to the excavating rig on a first end, the string having a flowpath provided along its axis, an excavating member affixed on the string second end, the member having a nozzle in fluid communication with the string flowpath, a flow dynamically circulating through the flowpath, into the excavating member, and exiting the nozzle into an annulus between the string and borehole, the flow having a slurry of fluid and impactors, and a control module adapted to calculate a realized WOB of the excavating member based on flow density and compare the realized WOB to a target WOB. The system may also include a monitoring module in communication with the control module and the excavating rig, the monitoring module adapted to generate a command directed to the excavating rig to apply a compensating force to the string based on the comparison of the realized WOB to the target WOB. The excavating member can be one of a drill bit, a milling bit, or a fishing bit. A densometer may be included that is in communication with the flow, so that when the densometer measures the flow density, the measured flow density can be compared with the flow density used for calculating a realized WOB. The control module may be adapted to calculate the realized WOB using a correction factor that accounts for movement of impactors in the flow. The control module can be adapted to execute on a processor that provides input to the monitoring module based on flow density variations throughout the flow circulation; wherein the flow density may increase as a result of an increase in an amount of impactors added to the flow, or decrease by a result of an addition of an addition of material to the flow having a lower density.

The system may include a block assembly provided with the excavating rig, wherein manipulating the block assembly applies the compensating force to the string, the controller in communication with the block assembly.

Further disclosed herein is an optional method of subterranean excavating. In the optional method, an excavation system is provided in a borehole, the excavation system having, a rig, a tubular string suspended in the borehole from the rig and held with a support force from the rig, the string having an axial bore, an excavating member string, a nozzle on the member in fluid communication with the string bore. Flow may then be circulated through the string bore to the excavating member, and through an annulus formed between the borehole and the string. A buoyancy force exerted on the string by the flow in the borehole can be estimated and a change in the buoyancy force identified. A compensating force can be applied compensating for the changed buoyancy force.

DETAILED DESCRIPTION OF THE INVENTION

Figure 1:
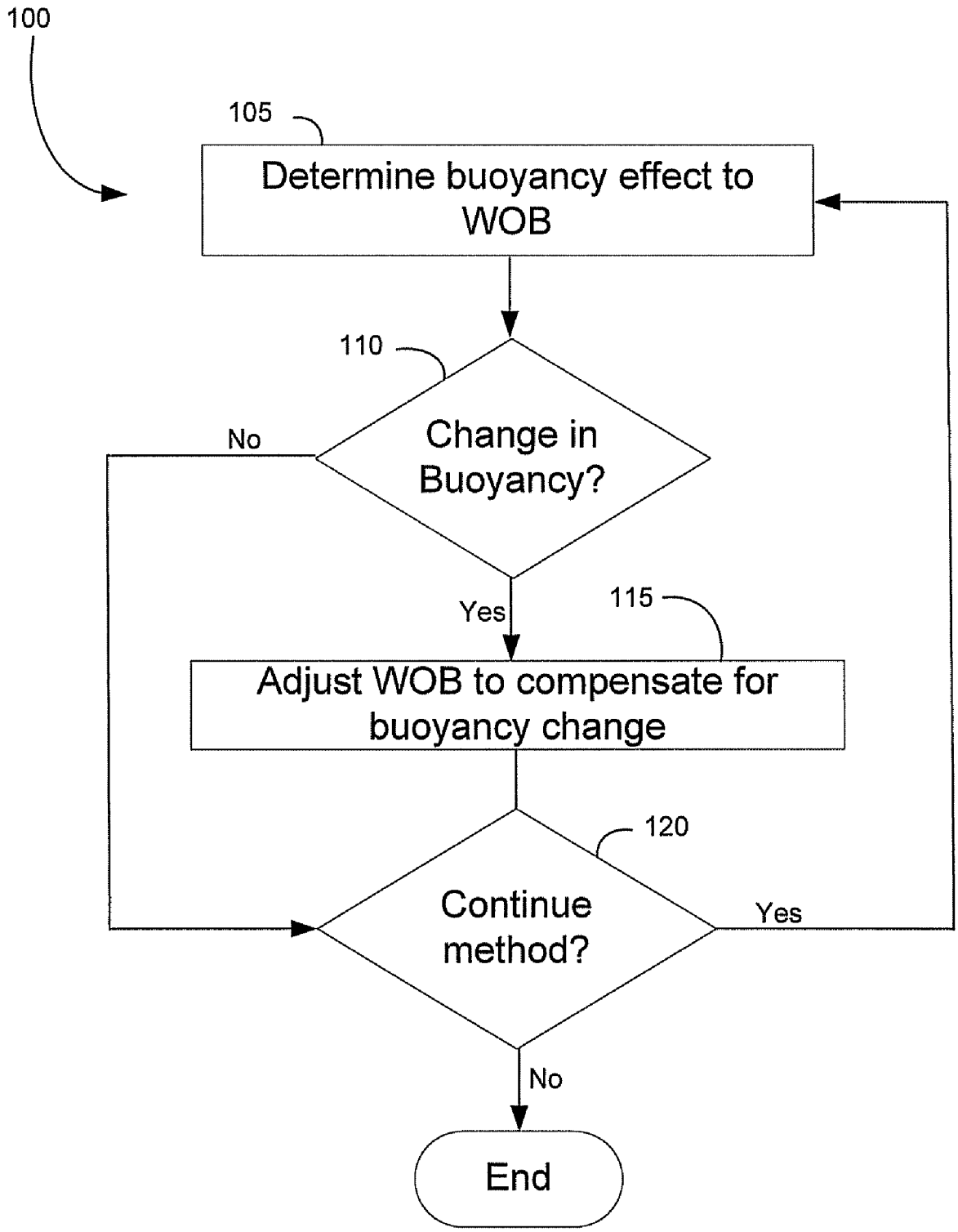
FIG. 1 is a flow chart depicting a method for controlling a force resulting from changes in buoyancy on a down-hole device in a down-hole material removal operation according to an exemplary embodiment.

Numerous drilling algorithms and programs that are designed to optimize performance of non-particle impact type drilling bits exist. Many major drill bit manufacturers have customized programs, which may or may not interface with particular automatic drilling equipment on drill rigs. Such programs typically optimize drilling performance by varying the WOB and rotary speed of the drill bit or other parameters. During operation, the torque developed by the drill bit during cutting operations is monitored, and the programs vary the drilling parameters to optimize the performance of the drill bit.

However, such programs do not consider the effects of dynamic density changes inherent with a particle impact type drilling system. Such programs do not analyze the "pump off force" (an effect caused by the slurry in the drill string) unless a natural diamond or impregnated drill bit is being used, and such programs also do not consider the dynamic effect of changes in flow density on the WOB. The realized WOB that traditional roller cone or polycrystalline diamond (PDC) bits actually applied at the borehole bottom typically ranges from about 20,000 lbs to in excess of 100,000 lbs. For the purposes of discussion herein, the term "realized WOB" can mean the force transferred between the borehole bottom and the string. Typically a drill string is refers to multiple segments of pipe threaded together having an excavating member (or drill bit) on its bottom end. However, for the purposes of discussion herein the term drill string can also include an excavating member or drill bit. WOB may be monitored by a weight indicator associated with the surface equipment. However the apparent WOB monitored at the surface will differ from the realized WOB due to forces such as buoyancy forces applied to the bit and drill string from the drilling fluid and resultant forces created by fluid exiting nozzles in the drill bit. Additionally, because of the higher WOB required for most non-particle impact type drilling systems WOB fluctuations from changes in fluid properties are typically considered insignificant and ignored. Thus the WOB has traditionally not been adjusted to compensate for changes in drilling fluid properties.

During excavation operations using particle impact type drilling, the majority of the down-hole material is removed by impacting high velocity particles, referred to herein as impact particles or impactors, into the formation. A small portion of the material at the bottom of the down-hole may be removed mechanically via the drill bit. Particle impact type drilling systems require, for example, only about 7,000 to 15,000 pounds WOB to generate excavation performance levels that are as much as three to five times greater than conventional bits; such as for 7⅞" and 8½" bits. Because the forces required to remove this small portion of the bottom hole are small, compared to conventional drilling requirements, parasitic losses to the realized WOB at the borehole bottom can and do become significant and can drastically reduce the performance of the particle impact type drilling system.

The impact particles used in excavating the bottom hole in particle impact drilling typically are made of steel and are dense compared to debris, such as rock, cuttings, and other excavated or milled materials, that may be removed from the wellbore. These particles used in drilling operations can have a density that is in the range of about two to about three times greater than that of the rock or other debris material being drilled and removed. The drilling slurry used in the particle impact type drilling system typically carries the debris and the impact particles from down-hole back to the surface. The impact particles may then be recovered and reused in further particle impact drilling. In one embodiment, a substantial portion by weight of the solid material impactors may have an average mean diameter of between about 0.05 inches to about 0.15 inches, in another embodiment impactor average diameter is about 0.075 inches to about 0.125 inches, in another embodiment impactor average diameter is about 0.078 inches in another embodiment impactor average diameter is about 0.100 inches.

As used in this document, the term "flow" means any combination of solids, liquids, or gasses known to or perceived to be in the wellbore. For example, flow can comprise the mixture created from one or more of the drilling fluid, other fluids present in the wellbore, debris, gasses, impact particles (if used with a particle impact type drilling system), and any other materials in the wellbore.

Because the higher mass particles are entrained in the flow that is returned to the surface during drilling operations, along with the debris that has been excavated from the bottom hole, the density of the returning slurry may be elevated when compared to a flow that contains only debris. The higher density flow thus exerts a higher buoyancy force to the bit bottom and the drill string (pipe) than flow without particles or debris or flow containing only debris. This increased buoyancy force is directed opposite to the WOB force thus reducing the realized WOB at the borehole bottom; which may be referred to as a buoyancy effect. Other causes can also reduce the realized WOB, such as the reactant forces generated by fluid and particles being accelerated through the nozzles contained in the drill bit. These other forces also have a greater effect in a particle impact type drilling system when compared to conventional systems, as the fluid velocities exiting the nozzles are about five times greater in the particle impact type drilling system.

Although the impact particles are added to the flow at a constant rate, their addition causes fluctuations in the realized WOB. For example, during drilling when the impactors are first introduced into the drill string they displace the lower density flow thereby increasing drill string weight to raise the realized WOB. The impactors exit the drill bit nozzle and flow into the annulus between the drill string and borehole wall increasing flow density in the annulus. Over time, the impactor particles sufficiently populate the annulus and raise the flow density in the annulus. The increased flow density in the annulus results in a buoyancy force applied to the drill string, that changes as the impactor level rises in the annulus thereby dynamically altering the realized WOB seen by the bit. This non-uniform and dynamic flow makes it difficult to apply corrective WOB to maintain the required WOB needed for the performance of the particle impact type drilling system.

The methods described herein can determine the changes in the forces that affect the realized WOB to the particle impact type drilling system, as the drilling operation proceeds, so corrections to the realized WOB will result in a substantially constant force actually applied to the excavation material in the bottom hole. Maintaining a realized WOB that is substantially constant can provide improved performance for the particle impact type drilling system, thereby saving time and cost for drilling operations. The methods described herein address one or more of the following parameters to maintain the realized WOB: the geometry of the wellbore, the rheological properties of the slurry, and the forces applied to the drilling system.

Regarding the geometry of the wellbore, changes in the diameter of the drill string, which can include drill pipe, drill collars, heavy weight drill pipe, and other drilling tools, and changes in the wellbore; affect wellbore geometry. The volume and density of flow in the string can be calculated based on the dimensions of these components and their materials, thereby accounting for the dynamically changing buoyancy of the drill string. The dimensions of the casing and open hole geometry also can be calculated based on the dimensions of these items, thereby further accounting for the dynamically changing buoyancy of the drill string. The rate of the flow, the geometry of the casing or open hole, and the corresponding drill string at any depth determine the velocity of the particle-laden flow and therefore the time rate of change of the flow density. This annular change in flow density and changing height of the annular column of flow allows correct application of compensatory WOB to the particle impact drilling system.

Based on the well geometry (as it changes in depth as the hole is drilled); the rate at which the particles are added and removed from the borehole; internal and annular pressure, impactors measured at the surface, drilling mud flow rates, slip velocity (described hereinafter), and rheological properties; nozzle geometry; drilling rate; rotary speed; realized WOB; the dynamically changing values of realized WOB and changes to parasitic losses or gains can be calculated and accurately compensated.

Regarding slip velocity, the slurry experiences dynamic changes as the impact particles separate dynamically from the flow front. The impactor to fluid separation rate can be referred to as the slip velocity. As drilling progresses, impact particles will be carried to surface at some rate less than or equal to the rate of the drilling fluid, depending on fluid properties. The drilling fluid rheology affects the degree to which the fluid and impact particles separate from each other. This dynamic separation of the flow leads to dynamic (time dependant) variations in the annular and pipe fluid densities, which in turn affects the WOB yet again. Further, as flow circulation is stopped during each connection, the impact particles further settle away from the remaining portion of the flow. This time dependency is different from conventional drilling where settling of cuttings can routinely be ignored because nominal error is less than nominal WOB. In practice, an accurate time accounting of all materials in the pipe and annulus can result in an increased accuracy of the true bottom hole WOB.

Further, the accuracy of the entire system described herein may be increased with the inclusion of a densometer and flow meter on the flow stream entering and leaving the wellbore. The densometer and flow meter can be used to determine a flow density and changes in the flow density over time.

Further still, the accuracy of the system may be increased by applying a correction factor that adjusts for the actual time required for impact particles or other materials to return to the surface in relation to the expected time for impact particles or other materials to return to the surface. This adjustment will allow for a gross correction to account for parameters not otherwise considered, such as vugular formations, hole sloughing, rheology changes due to down-hole fluids or gases, or other parameters.

These variables can be monitored continuously during a drilling operation, and the WOB adjustments can be calculated at or near real time to provide inputs for adjusting the WOB to optimize drilling performance. The adjustments can be applied manually, or further optionally applied automatically via a processor controlled system, or optionally applied via a combination of a manual or automatic adjustment.

Turning now to the drawings, in which like numerals are intended to indicate like elements throughout the figures, exemplary embodiments of the invention will be described. An exemplary method for adjusting a force on an excavating member in a down-hole material removal operation will now be described with reference to FIGS. 1-4. FIG. 1 is a flow chart depicting a method 100 for controlling a force on an excavating member in a down-hole material removal operation according to an exemplary embodiment. In an exemplary embodiment, the force can be the realized WOB of a drill bit in drilling operation, as discussed in detail with reference to FIGS. 1-4. In alternative exemplary embodiments, the method 100 can be used to control a force on other down-hole types of devices performing different types of material removal operations, such as milling or fishing operations. Thus embodiments of an excavating member include a drill bit, a milling bit, a fishing bit and any other device for grinding solid matter.

In step 105, the method 100 determines the buoyancy effect of the flow density on the realized WOB. Step 105 will be further described in detail hereinafter with reference to FIG. 2.

In step 110, the method 100 determines whether a change in the buoyancy effect has occurred. Step 110 will be further described in detail hereinafter with reference to FIG. 3. If a buoyancy change was detected in step 110, the method proceeds to step 115; if no potential change in buoyancy the method proceeds to step 120. In step 115 the method 100 applies a compensating force to the string to compensate for the change in the buoyancy effect thereby adjusting the realized WOB. Step 115 will be further described in detail hereinafter with reference to FIG. 4. One example of applying a compensating force is increasing or reducing a a support force applied to a drill string through a crown block. The drill string support force can be a hook load.

Then, in step 120, the method 100 determines whether to continue adjusting the WOB in the down-hole drilling operation. In one optional embodiment, the method 100 can be performed as long as drilling operations continue. For example, if the method 100 determines in step 120 to continue adjusting the WOB in the down-hole drilling operation, then the method 100 may branch back to step 105. If the method 100 ceases adjusting the WOB in the down-hole drilling operation, then the method 100 may end.

Figure 2:
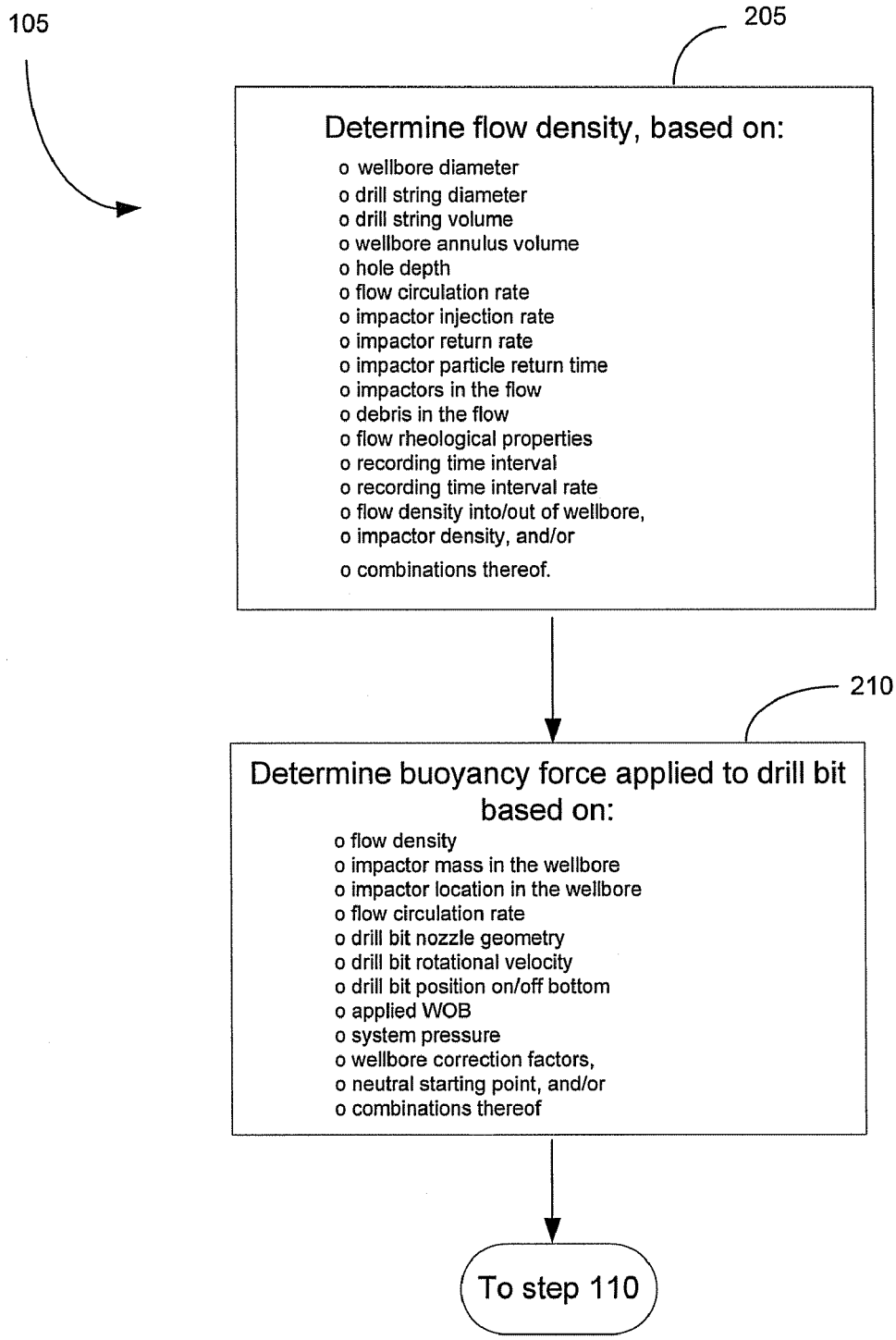
FIG. 2 is a flow chart depicting a method for determining the buoyancy effect of the flow density on the applied WOB according to an exemplary embodiment.

FIG. 2 is a flow chart depicting a method 105 for determining the buoyancy effect of the flow density on the realized WOB according to an exemplary embodiment. In step 205, the method 105 determines the density of the flow. In this embodiment, the flow density is based on, at the time of the determination, at least one or more of: wellbore diameter, drill string diameter, volume occupied by the drill string, the volume of the annulus surrounding the drill string, the hole depth, a rate of impact particle injection, a rate of impact particle return, impactor density, an observed time for impact particle return after injection, an amount of impact particles in the flow, an amount of debris in the flow, rheological properties of the flow, the amount of particles observed at surface or estimated to be downhole, a time between parameter recordings, a time rate of change of a parameter recording, a flow density entering and/or exiting the wellbore, any other suitable factor, and/or combinations thereof. Other factors can affect the density of the flow and can also be considered when determining the density of the flow. For example, temperature, pressure, changes in the base drilling fluid, or other factors can affect the density of the flow and can be considered when calculating the flow density.

In an exemplary embodiment, the parameters discussed above can be obtained on a real-time basis by continually monitoring the drilling operation. Accordingly, the density of the flow can be calculated on a corresponding real-time basis. For example, as impact particles, or impactors, are initially introduced into the flow, the density of the flow will increase over time until the impact particles are distributed throughout the slurry. Accordingly, the density of the flow can be determined as a function of time as the impact particles are continually introduced into the flow.

In step 210, the method 105 determines the buoyancy effect on the down-hole device. The embodiment of step 210 estimates the buoyancy effect based on at least one of: the initial weight of the drill string suspended in the impactor free drilling mud (normal buoyancy of the drill string), the flow density, the mass and location of impact particles in the wellbore, the flow flow rate, the nozzle geometry of the drill bit, the rotary speed of the drill bit, on-bottom/off-bottom position of the drill bit, impactor density, correction factors for particle injection/return, the realized WOB, any other suitable parameter, and/or combinations thereof. For example, a buoyancy of the flow can be determined based on the flow density; an upward force on the drilling system can be determined based on the flow flow rate, the nozzle geometry of the drill bit, and the rotary speed of the drill bit; and the realized WOB can be used to determine a corresponding downward force. Then, one or more of those items and the correction factors can be used to determine the net force that is the buoyancy effect.

Correction factors can be based on historical data for a particular wellbore. For example, data can be obtained over time to measure the actual time for injected impact particles to return to the surface in a particular wellbore. Then, a correction factor based on the actual time can be applied to the density calculations to adjust the predicted density accordingly. The return time affects the amount of impact particles in the wellbore. For example, an actual return time that is longer than the estimated return time means that the amount of impact particles in the wellbore is greater than anticipated. Accordingly, the correction factor can adjust the density calculations to account for the increased amount of impact particles in the wellbore. Similarly, correction factors can adjust for an actual return time that is less than the estimated return time. In an exemplary embodiment, correction factors can be stored in a database for use in the density calculations. Correction factors developed for a particular wellbore can be used to predict correction factors for a different wellbore. Using the predicted correction factors can result in more accurate density measurements prior to actually observing the impact particle return time. Then, the density calculations can be refined for correction factors based on actual return time.

From step 210, the method 105 may then proceed to step 110 (FIG. 1).

Figure 3:
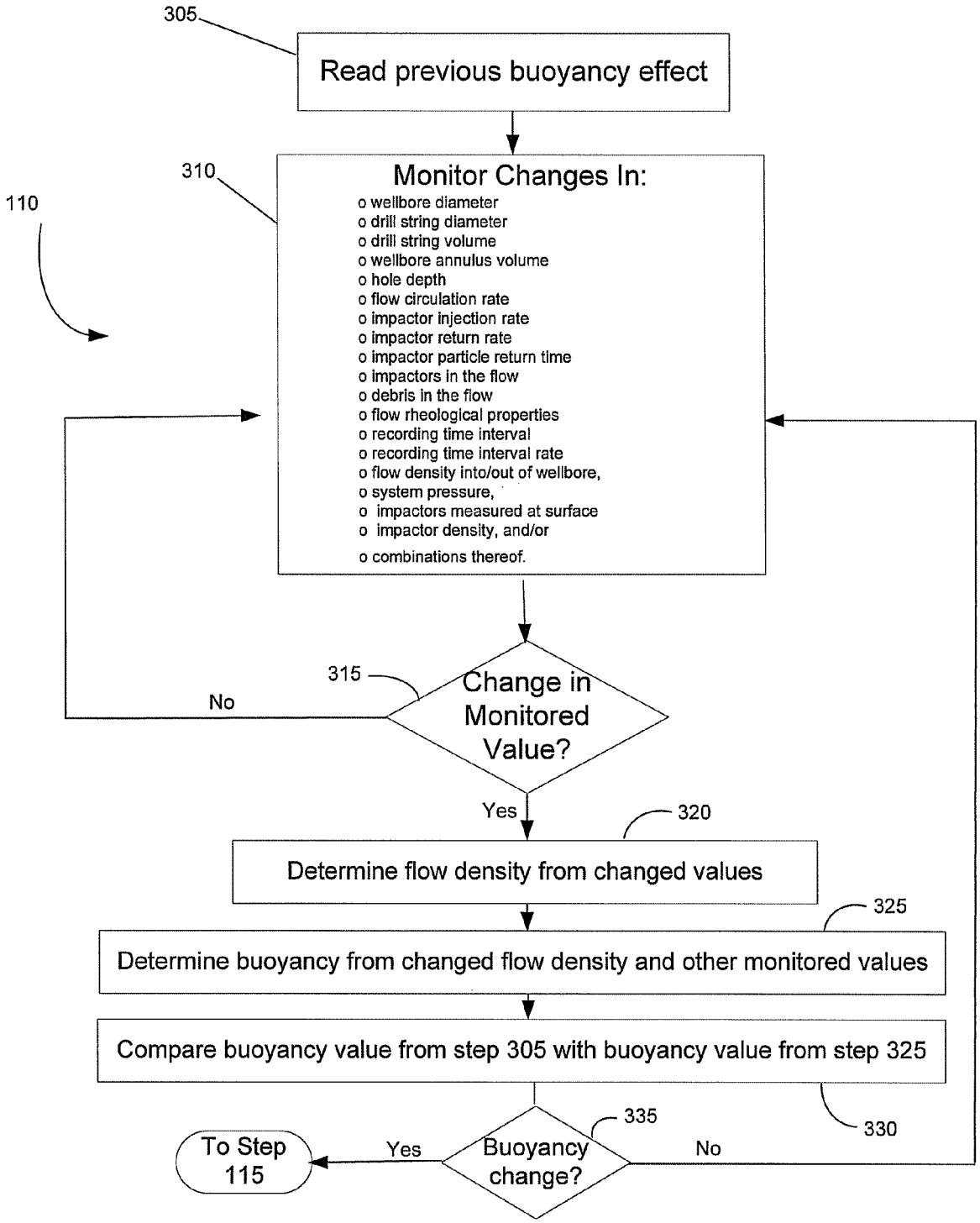
FIG. 3 is a flow chart depicting a method for determining whether a change in the buoyancy effect has occurred according to an exemplary embodiment.

FIG. 3 is a flow chart depicting a method 110 for determining whether a change in the buoyancy effect has occurred according to an exemplary embodiment. In step 305, the method 110 reads the previous buoyancy effect. For a drilling operation's initial pass, the previous buoyancy force can be zeroed or normalized to the benchmark starting value, a predetermined starting value chosen to provide an initial WOB, or another setting for the operation.

In step 310, the method 110 monitors for changes in parameters that can affect the buoyancy. For example, the method 110 can monitor for changes in the diameter of the drill string components, the volume of the annulus surrounding the drill string, the hole depth, the rate of the flow if any, the rate of impact particle injection if any, the rate of impact particle return if any, the observed time for impact particle return after injection (if applicable), the amount of impact particles in the flow (if any), the amount of debris in the flow (if any), on-bottom/off-bottom position of the drill bit (if any), the rheological properties of the flow (if known), the nozzle geometry of the drill bit (if known), the rotary speed of the drill bit (if known), the realized WOB (if any), the time between parameter recordings, the time rate of change of any parameter recordings, the density of the flow going into and/or exiting the wellbore, and any other suitable parameter. Other parameters also can be monitored for changes that may affect the density of the flow. For example, temperature, pressure, changes in the base drilling fluid, or other parameters also can be monitored. In general, the more parameters that are measured, the more accurate the resulting WOB correction factor may become.

In step 315, the method 110 determines whether a change has occurred for any of the monitored values. For example, the method 110 can compare the values obtained in step 310 with the values obtained in step 205 or step 210 of FIG. 2 to determine whether a change has occurred for any of the monitored values. If a change has not occurred, then the method 110 branches back to step 310 to continue monitoring the parameters. If a change has occurred, then the method 110 branches to step 320.

In step 320, the method 110 determines the present system flow density based on the monitored values, similar to the determination of step 205 of FIG. 2. In step 325, the method 110 determines the present buoyancy effect based on the present flow density and other monitored values, similar to the determination of step 210 of FIG. 2.

In step 330, the method 110, compares the previous buoyancy effect to the current buoyancy effect. In step 335, the method 110 determines whether a difference exists between the previous and present buoyancy effects. The method 110 then proceeds to step 115 (FIG. 1).

Figure 4:
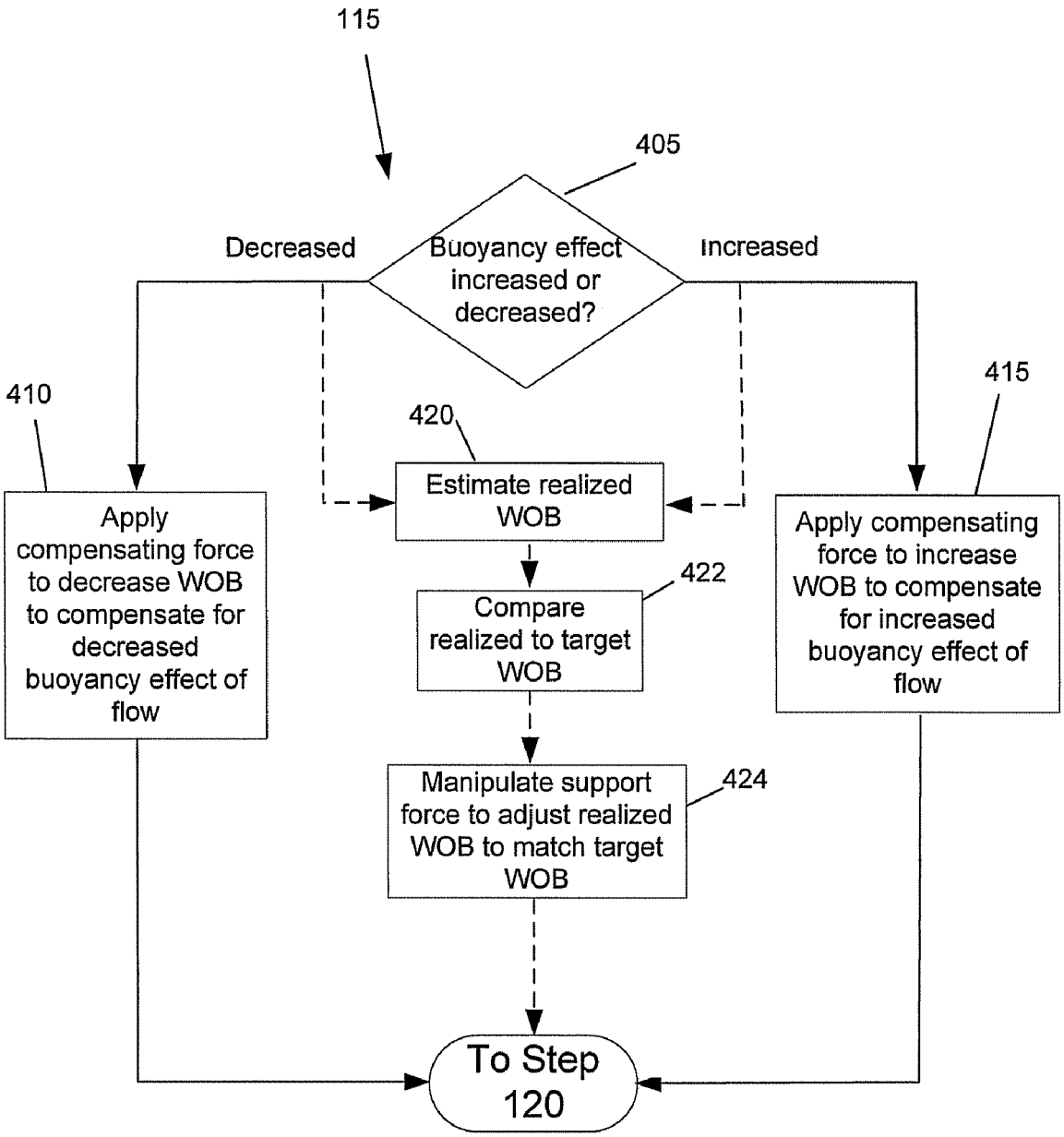
FIG. 4 is a flow chart depicting a method for adjusting the WOB to compensate for a change in the buoyancy effect according to an exemplary embodiment.

FIG. 4 is a flow chart depicting a method 115 for adjusting the WOB to compensate for a change in the buoyancy effect according to an exemplary embodiment. In step 405, the method 115, in one embodiment, uses the results of step 335 of FIG. 3 to determine whether the buoyancy effect has increased or decreased. If the buoyancy effect has decreased, then the method 115 branches to step 410 in which an applied compensating force is provided by an adjusted WOB amount or change in WOB as an example of compensating for the decreased buoyancy effect of the flow. Alternatively, if the buoyancy effect has increased, then the method 115 branches to step 415 in which an applied compensating force is substantially the same as an adjusted WOB amount or change in WOB as an example of compensating for the increased buoyancy effect of the flow. The method 115 then proceeds to step 120 (FIG. 1). Steps 420, 422, and 424 provide an alternate manner of adjusting the support force to attain a desired realized WOB. Step 420 includes estimating a realized WOB using the updated flow information. In step 422 the realized WOB is compared to a target WOB and an applied compensating force is applied in step 424 to adjust the realized WOB to approximate the target WOB.

In an alternative embodiment, step 110 of FIG. 1 can be omitted, and the method 100 can loop indefinitely without comparing current values to previous values, thereby running in a continuous loop. For example, the method can determine the buoyancy effect of the flow density on the realized WOB (step 105) and then proceed to step 115 to adjust the realized WOB to compensate for a change in the buoyancy effect. The method 100 can then loop between steps 105 and 115 to continuously adjust the realized WOB.

In an exemplary embodiment, the WOB is controlled within a range of about 1,000 pounds to about 50,000 pounds. In an alternative exemplary embodiment, the WOB is controlled within a range of about 1,000 pounds to about 25,000 pounds. In another alternative exemplary embodiment, the WOB is controlled within a range of about 7,000 pounds to about 15,000 pounds.

The exemplary methods described with reference to FIGS. 1-4, or suitable adaptations thereof, can be implemented manually, via a computer processor, or via a combination thereof to control the force on a down-hole device in a material removal system. For example, the processor can perform the monitoring functions, determine any changes in the buoyancy effect, and issue commands to the system to adjust the WOB in accordance with the determination. The system can adjust the WOB in response to receiving the commands from the processor.

Although described previously with reference to controlling the WOB in a particle impact type drilling system, the exemplary methods described herein also can apply to non-particle impact type drilling systems. When drilling with such conventional drilling systems at high rates of penetration, the same issue of dynamic buoyancy can affect the accurate application of WOB where a lower range WOB can be utilized. For example, the specific gravity of rocks in general is about 2.6. The specific gravity of particles in a particle impact type drilling system is about 7.8. By drilling three times faster with a conventional drill bit, for example, in soft to medium formations, the dynamic buoyancy in a non-particle impact type drilling system can be affected by the large volume of debris being generated and entrained in the annular drilling slurry returning to the surface. Thus, performance of conventional drilling systems can be improved by determining the actual required WOB based on the methods described herein to compensate for the dynamically changing density of the annular column of slurry due to the increased introduction of debris into the slurry during drilling operations.

Although described previously with reference to controlling the WOB in a down-hole drilling system, the exemplary methods described herein are suitable for controlling a force on other types of down-hole devices in material removal systems. For example, the methods described with reference to FIGS. 1-4, or suitable adaptations thereof, can be used to control the force on a down-hole device in a drilling, milling, or fishing system. For example, the methods described herein are useful in drilling, milling, and fishing applications. Milling is a process in the drilling industry of removing something downhole by breaking it up into small or smaller particles. Milling can be used to remove a broken piece of tool lodged in a wellbore, remove a section of casing, or to create a casing exit. In this case, the down-hole device is a milling tool that cuts a section of casing for removal or that cuts an exit opening in the casing. Fishing is a process for removing a blockage, such as a piece of the drill string that is lodged in the wellbore. In this case, the down-hole device is a type of mill called a fishing tool, which may grind up or cut away the obstruction. Milling and fishing operations generate steel shavings that are introduced into the slurry, thereby dynamically changing the density of the slurry and the actual weight on bit for the down-hole device.

Figure 5:
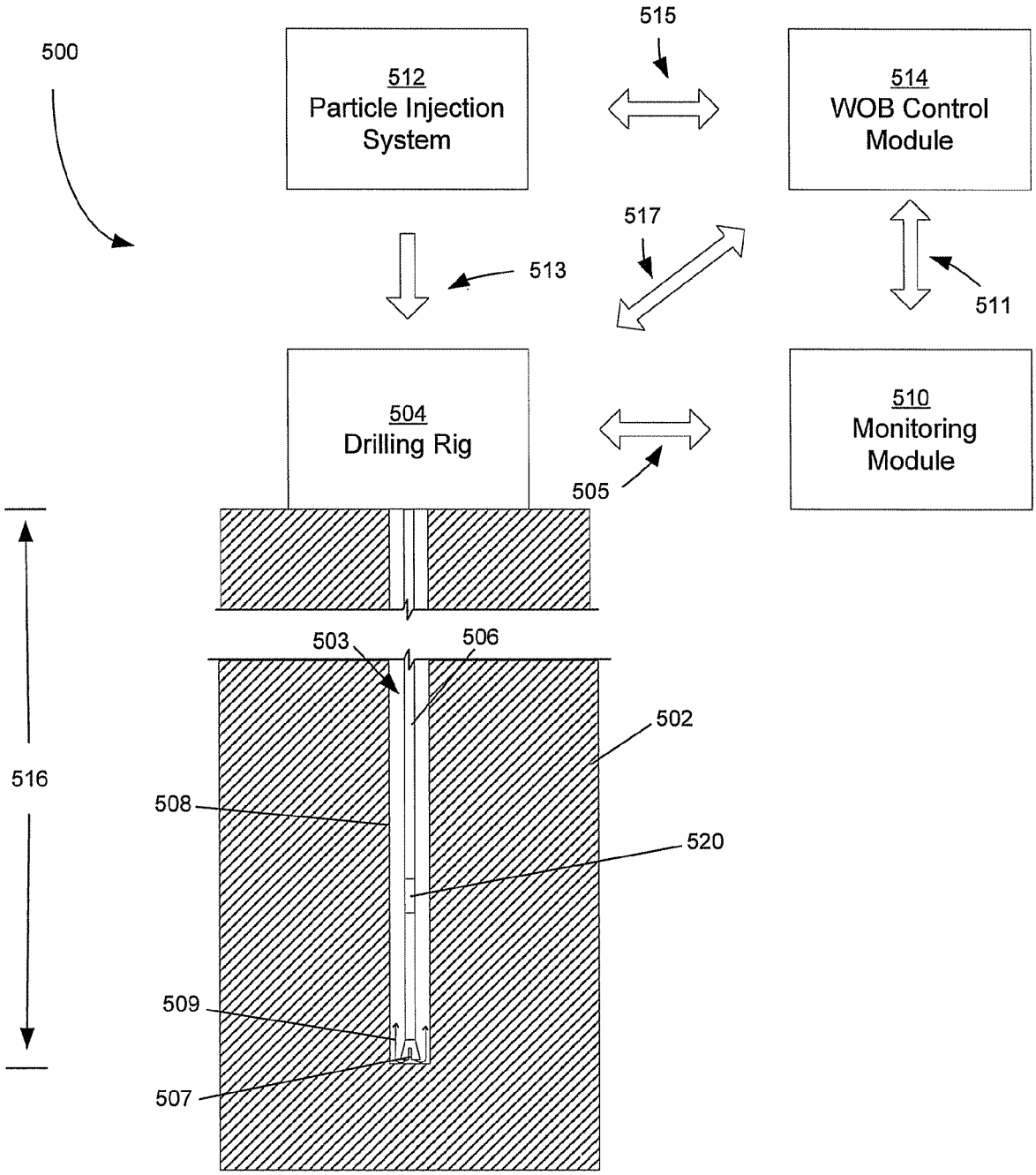
FIG. 5 is a block diagram illustrating a system for controlling a force on a down-hole device according to an exemplary embodiment.

FIG. 5 is a block diagram illustrating a system 500 for controlling a force on a down-hole device according to an exemplary embodiment. In the example illustrated, a drilling rig 504 is operating a drill string 506, including a down-hole device 507, in a wellbore 508 that intersects a formation 502. In exemplary embodiments, the down-hole device 507 can comprise a drill bit, a milling device, a fishing device, or other suitable down-hole device. Arrows 509 represent flow exiting the device 507, the flow may comprise, drilling fluid or mud or a slurry of drilling fluid and impactors.

A monitoring module 510 monitors information regarding the down-hole operation conducted by the drilling rig 504. In exemplary embodiments, the monitoring module 510 can obtain down-hole operation information ("drilling data") regarding one or more of: the diameter of the wellbore 508, the diameter of the drill string 506, the volume occupied by the drill string 506, the volume of an annulus 503 surrounding the drill string 506, the hole depth 516, on-bottom/off-bottom position of the down-hole device 507, an amount of debris in the slurry (if any), the slurry flow rate (if any), and/or any other suitable parameter of the down-hole operation, and/or combinations thereof.

The monitoring module 510 may communicate the drilling data to a WOB control module 514 (as well as other modules)

via an interface 511. The interface 511, represented by a double headed arrow, may be any data communication link, examples include cable, wire, and wireless telemetry. Optionally, the monitoring module 510 can communicate with the WOB control module 514 via an industry standard interface, such as a Wellsite Information Transfer Specification (WITS) interface.

In one exemplary embodiment, the WOB control module 514 calculates the buoyancy effect of the flow and a WOB adjustment based on the drilling data and communicates the WOB adjustment data to the monitoring module 510, such as by the interface 511. In an exemplary embodiment, the monitoring module 510 can automatically adjust the operation of the drilling rig 504 to implement the WOB adjustment from the WOB adjustment data by issuing an adjustment command to the drilling rig 504. An interface 505 illustrates communication between the module 510 and the rig 504. In an alternative exemplary embodiment, the monitoring module 510 can display the WOB adjustment data to an operator of the drilling rig 504, and the operator can manually implement the WOB adjustment in accordance with the WOB adjustment data. Optionally, the control module 514 can issue a control command directly to the drilling rig 504 via interface 517. A controller (not shown) within the drilling rig 504 can receive the command and take action responsive to the command.

In one optional embodiment the applied compensating force for adjusting WOB is provided by a thrust force that is applied to the string. The thrust force may be applied by a device combined with the drill string proximate to an excavating member. In one embodiment, the device applies a substantially constant force to the excavating member thereby maintaining the realized WOB at or close to the target WOB. Such a device for applying a compensating force may be one that operates independent of drill string axial loads. Due to the drill string length and elasticity, the string often deforms through torsion, compression or elongation in response to loads applied at the surface. The drill string deformation absorbs at least a portion of the loads transferred to the excavating member through the string (i.e. a string dependent load). An example of a device that provides a load independent of the string for adjusting WOB is referred to herein as a compliant member. A compliant member may be a thruster, a hydraulic balanced loading device, a load decoupling device, and the like. The compliant device can be activated by supplying a pressure to a cavity between the drill string and the thruster drive shaft. The pressure acts on both the area of the drive shaft and the drill string, loading the two components axially with equal and opposite forces. The downward component load provides WOB and the upward component of the force will reduce the hook load (support force). In one example, a compliant device is used to provide a compensating force to the excavating member or drill bit by adjusting drill string flow, such as for example flow rate, pressure, and/or flow properties. Those skilled in the art are capable of identifying and installing a compliant member for providing a compensating force. As shown in FIG. 5, an optional thruster 520 adapted to apply a thrust force to the drill string is provided integral with the drill string 506. An example of a thruster 520 suitable for this application Dailey® CBC-Thruster™ Tool that can be obtained from Weatherford International Ltd., 515 Post Oak Blvd., Suite 600, Houston, Tex. 77027 USA, Tel: 713-693-4000, weatherford.com. Optionally, a thruster can provide the entire WOB compensation, a portion thereof, or none. The thruster can be used in combination with adjusting the hook load on the crown block.

The drilling rig 504 can optionally be operated in combination with a particle injection system 512. The particle injection system 512 can inject impactors via an injection path 513 to the drilling rig 504 for addition to the flow circulating in the drill string 506 and the annulus 503 of the wellbore 508. The particle injection system 512 can obtain data regarding the particle injection operation ("injection data"). In exemplary embodiments, injection data can comprise one or more of the rate of impact particle injection, the rate of impact particle return, the observed time for impact particle return after injection, the amount of impact particles in the flow, the amount of debris in the flow, and the rheological properties of the flow. The particle injection system 512 may optionally communicate the injection data to the WOB control module 514 via interface 515.

In exemplary embodiments, the WOB control module 514 can calculate the buoyancy effect of the flow based on at least one of the drilling data and the injection data in accordance with the methods described previously with reference to FIGS. 1-4.

The exemplary modules 510 and 514 illustrated in FIG. 5 can be at least partially implemented as software executing on a computer processor that controls the force in a material removal system. In accordance with exemplary embodiments, the modules 510 and 514 can be implemented via the same processor or via multiple processors and can be located with the drilling rig 504, the particle injection system 512, and/or remotely from those items. Optionally, all of the rig 504, system 512, and modules 510 and 514 can be included in a single unit or system.

As shown above, examples of calculating or estimating the quantity of impactors in the annulus may be based on the injection rate, slip velocity, and incorporating correction factors for actual impactor return to the surface. Optionally, the starting volume of impactors may be measured then a mass balance of the impactors in the system performed to arrive at the volume of impactors in the annulus affecting the buoyancy. By knowing the amount injected into the surface piping and inside the drill string, a known quantity (rate of shot times the time of injecting and the volume of the piping) and the weight of the returned impactors (neglecting the relatively very small volume in the separation system), the volume of impactors in the annulus can be obtained.

In exemplary embodiments, formulas for density, mud rheology, and buoyancy calculations can be found in accepted drilling technology texts, for example, *Applied Drilling Engineering*, Bourgoyne et al., Society of Petroleum Engineers (1991) and *Standard Handbook of Petroleum and Natural Gas Engineering*, Lyons et al., Elsevier Inc. (2005).

An optional computer program may be employed that embodies the functions described herein and illustrated in the appended flow charts. However, it should be apparent that there could be many different ways of implementing the computer program, and thus the present disclosure is not limited to any one set of computer program instructions. Further, a programmer having ordinary skill in the art would be able to write such a computer program to implement an embodiment based on the flow charts and associated description in the application text. Therefore, disclosure of a particular set of program code instructions is not necessary for an adequate understanding of how to make and use the method described herein. The inventive functionality of the claimed computer program has been explained in detail in the description and the figures illustrating the program flow.

Figure 6:
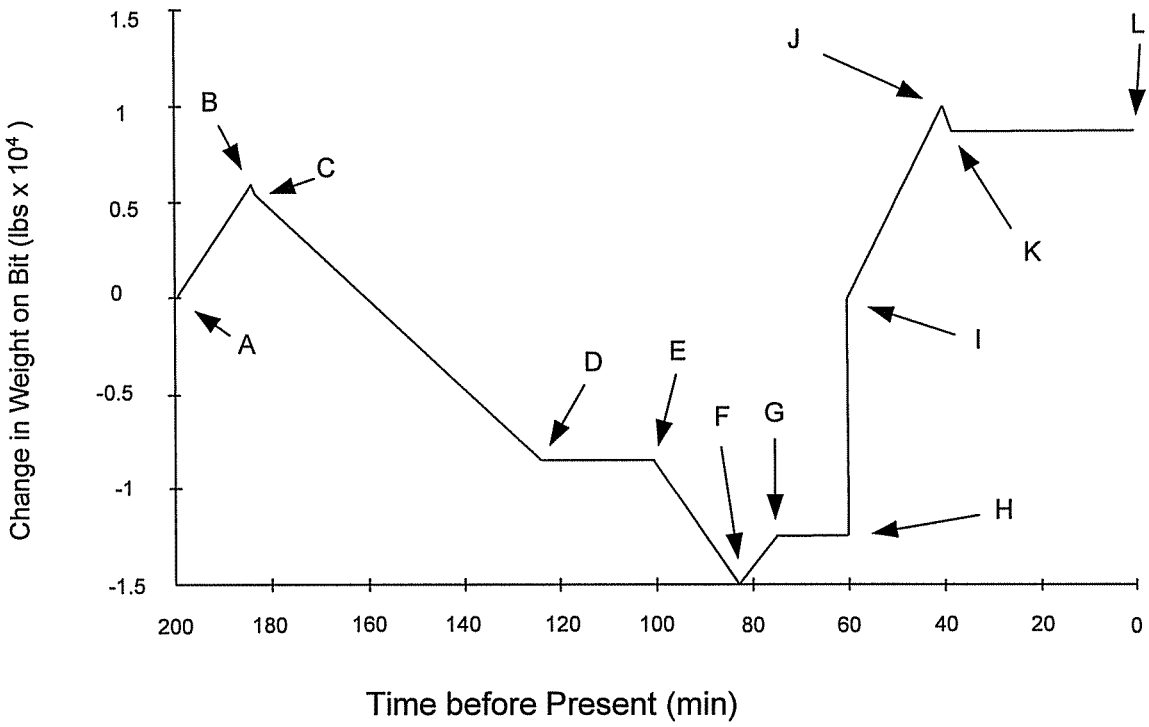
FIG. 6 graphically depicts changes in WOB over time resulting from flow density changes caused by injecting solid metal impactors.

With reference now to FIG. 6, an example of changes to WOB over time is graphically presented. The changes to the WOB of FIG. 6 are examples of how operating an impactor excavating system changes the realized WOB over time. Based on the changes to the WOB, a compensating force can be applied to compensate for the changes to realized WOB. The adjustments may be automatic per the control system above described or can be manually performed. The adjustments can be made by manipulating the crown block assembly as well as applying a thrust to the drill string. The operational sequence example charted in FIG. 6 extends from particles initially entering the drill string, flowing up the annulus, during a connection, and after the connection is made to t=0.

The graph's abscissa in FIG. 6 depicts time in minutes having its origin at 200 minutes before t=0. The graph's ordinate represents the change in WOB due to all of the factors considered in the control method, including the change in buoyancy due to dynamic density changes in the flow system. The ordinate's origin represents the condition where the bit is just touching bottom with no weight applied, or optionally the change in WOB from a given continuous support force. The calculations are for a given well design having drill pipe, drill collars, a casing design, and both fluid and particle flow rates defined. In one example, the change in WOB is derived by setting a target WOB equal to the WOB at t=200 min before present. It should also be pointed out that the adjustments to WOB can include adding force to the drill string to increase an existing WOB or removing force from the drill string to reduce an existing WOB.

At point A in FIG. 6 the impactors just enter the interior of the drill string and are being pumped towards the bit. Between the points A and B, the realized WOB is increasing as the higher density slurry is displacing the drilling mud. The WOB increase is fairly linear as the drill string internal diameter is substantially constant, so at a constant flow rate there is little change in the slurry velocity. At point B the slurry reaches the bit and passes through the nozzles and begins the trip back to the surface. Between points B and C the slurry is being lifted through the relatively thin annulus between the drill collars and the borehole wall. Because the flow's rate of circulation is relatively constant, the slurry velocity through the thin annulus is greater than other points in the flow circuit. Accordingly, the rate the change of buoyancy is also higher; as reflected in the steep slope between points B and C.

From point C to D, the slurry is traveling up the annulus at a calculated velocity based on the slip velocity of the particles. The slip velocity defines impactor velocity upward through the annulus. Gravity acting on the particles lowers impactor velocity below the fluid velocity. The cased wellbore and substantially constant slurry velocity results in a buoyancy changes to be generally linear. At point D, the slurry carrying the particles reaches the surface where particles are reclaimed and re-injected into the drill string.

The buoyancy between point D and E does not change as the system has reached steady state, i.e. the volume of particles being injected into the drill string is the same as what is being recovered at the surface. Between point E and F, to prepare for a drill pipe connection the impactor injection is ceased and the interior of the drill string is being pumped clear of the slurry. This reduces drill string weight thereby increasing buoyancy. At point F the slurry is pumped past the bit and the annulus is also being cleared of slurry up to the top of the drill collars. The total annulus density is reduced which decreases the buoyancy force applied to the bit.

At point G the fluid pumps are turned off to stop flow for allowing a drill pipe connection. Between points G and H the drill pipe connection is being made. At point H, the connection has been made and prior to starting the pumps and flowing particles, the WOB is set to zero at the weight indicator and the control method to account for the weight of the newly attached drill pipe at point I. The weight of the attached pipe section is illustrated by the infinite slope of the line between points H and I. The fluid pumps are started at point I and slurry injection is started into the drill string. The slurry is pumped downhole to the bit again and at the same time, the volume of drill fluid without particles is being pumped up the annulus between the particles present in the hole prior to adding the connection and the particles injected after connecting the pipe section.

At point J the particles pass through the bit and drilling starts again. The system is at a steady state with the same volume of particles being pumped into the drill pipe as is being retrieved at the surface. This steady state will continue until the particle free volume reaches the surface. At this point a new steady state condition exists with a denser annulus fluid due the replacement of the non particle bearing mud with impactor laden slurry. The cycle repeats itself with the addition of more drill pipe as the hole is drilled deeper and continuous corrections are made to the WOB with depth.

In another embodiment, monitoring supply pressure changes can be used for determining buoyancy change(s), and therefore the necessary WOB compensating adjustment to maintain a target WOB. Important buoyancy force changes take place after the impactors pass through the bit. The supply pressure at this point is a benchmark that can be used to compare the dynamic changes in flow density by supply pressure changes. Flowing impactors into the annulus increases column density, thereby increasing supply pressure requirements to maintain flow circulation. The supply pressure increase is proportional to the impactor increase in the annulus, which also changes flow density. By equating the required supply pressure to the changing flow density, the changes in buoyancy force can be obtained and used to adjust the apparent WOB to the target WOB.

Many other modifications, features, and embodiments of the invention will become evident to those of ordinary skill in the art. It should be appreciated, therefore, that many aspects of the invention were described above by way of example only and are not intended as required or essential elements of the invention unless explicitly stated otherwise. Accordingly, it should be understood that the foregoing relates only to certain embodiments of the invention and that numerous changes can be made therein without departing from the spirit and scope of the invention as defined by the following claims. It should also be understood that the invention is not restricted to the illustrated embodiments and that various modifications can be made within the scope of the following claims.

What is claimed is:

1. A method of subterranean excavating comprising:

(a) providing an excavation system in a borehole, the excavation system having, a rig, a tubular string suspended in the borehole from the rig and held with a support force from the rig, the string having an axial bore, an excavating member on an end of the string, a nozzle on the member in fluid communication with the string bore;

(b) pumping a fluid into the string bore, so that when the fluid forms a continuous flow through the string bore to the excavating member where it exits the nozzle and courses through an annulus formed between the borehole and the string;

(c) identifying a target WOB;

(d) estimating a realized WOB based on a flow density; and (e) applying a compensating force to the string so that the realized WOB is approximately the same as the target WOB.

2. The method of claim 1, further comprising adding impactors to the fluid to form a slurry in the flow, wherein the slurry density exceeds the fluid density.

3. The method of claim 2, wherein the impactors are substantially spherical metallic members.

4. The method of claim 2, further comprising estimating realized WOB based on an estimated and/or measured pressure in the flow.

5. The method of claim 4, further comprising dynamically controlling WOB, so that when changes in flow density occur within the drill string, the annulus, or the drill string and annulus, the realized WOB can be maintained at substantially the target WOB.

6. The method of claim 1, wherein the excavating member comprises an excavating element selected from the list consisting of a drill bit, a mill, and a fishing tool.

7. The method of claim 1, further comprising estimating flow density based on a parameter selected from the list consisting of, wellbore diameter, drill string diameter, drill string volume, wellbore annulus volume, hole depth, flow circulation rate, impactor injection rate, impactor return rate, impactor particle return time, impactors in the flow, debris in the flow, slurry rheological properties, recording time interval, recording time interval rate, flow density into/out of wellbore, impactor density, low gravity material volume and/or density, and combinations thereof.

8. The method of claim 7, further comprising measuring flow density using a densometer and comparing the measured flow density with the estimated flow density.

9. The method of claim 1, further comprising calculating the realized WOB using a correction factor that accounts for movement of impactors in the flow, wherein impactor movement within the flow can change pressure in the borehole and thereby change realized WOB.

10. The method of claim 9, wherein the correction factor is based on historical data selected from the list consisting of data collected from the borehole and data collected from another borehole.

11. The method of claim 9, further comprising measuring impactors at the surface.

12. The method of claim 1, further comprising calculating the buoyancy force applied to the excavation member by the flow, wherein the buoyancy force is based on a parameter selected from the list consisting of, flow density, flow circulation rate, nozzle geometry, excavating rate of penetration, and combinations thereof.

13. The method of claim 1, further comprising implementing a controller for performing steps (d) and (e) to automate the steps of estimating WOB and adjusting to compensate for changes to the WOB.

14. The method of claim 1, further comprising manipulating a device mechanically coupled to the string to perform step (e), wherein the device is selected from the list consisting of a block assembly and a compliant member in the tool string.

15. The method of claim 1, wherein step (e) compensates for an increase in estimated realized WOB.

16. The method of claim 1, wherein step (e) compensates for a decrease in estimated realized WOB.

17. An excavating system for excavating downhole comprising:

an excavating rig;

a string deployable downhole coupled to the excavating rig on a first end, the string having a flowpath provided along its axis;

an excavating member affixed on the string second end, the member having a nozzle in fluid communication with the string flowpath;

a flow dynamically, continuously circulating through the flowpath, into the excavating member, and exiting the nozzle into an annulus between the string and borehole, the flow having a slurry of fluid and impactors; and a control module adapted to calculate a realized WOB of the excavating member based on a flow density and compare the realized WOB to a target WOB, a monitoring module in communication with the control module and the excavating rig, the monitoring module adapted to generate a command directed to the excavating rig to apply a compensating force to the string based on the comparison of the realized WOB to the target WOB.

18. The system of claim 17, wherein the excavating member comprises an element selected from the list consisting of a drill bit, a milling bit, and a fishing bit.

19. The system of claim 17, further comprising a densometer in communication with the flow, so that when the densometer measures the flow density, the measured flow density can be compared with the flow density used for calculating a realized WOB.

20. The system of claim 17, wherein the control module is adapted to calculate the realized WOB using a correction factor that accounts for movement of impactors in the flow.

21. The system of claim 17, the control module executing on a processor that provides input to the monitoring module based on flow density variations throughout the flow circulation.

22. The system of claim 21, wherein the flow density may increase as a result of an increase in an amount of impactors added to the flow, or decrease by a result of an addition of material to the flow having a lower density.

23. The system of claim 17, wherein the impactors have a mean diameter of about 0.075 inches.

24. The system of claim 17, further comprising a block assembly provided with the excavating rig, wherein manipulating the block assembly applies the compensating force to the string, the controller in communication with the block assembly.

25. A method of subterranean excavating comprising:

(a) providing an excavation system in a borehole, the excavation system having, a rig, a tubular string suspended in the borehole from the rig and held with a support force from the rig, the string having an axial bore, an excavating member string, a nozzle on the member in fluid communication with the string bore;

(b) circulating continuously a flow having a varying density through the string bore, to the excavating member, and through an annulus formed between the borehole and the string;

(c) estimating a buoyancy force exerted on the string by the flow in the borehole;

(d) identifying a change in the buoyancy force; and (e) compensating for the changed buoyancy force by applying a compensating force to adjust a realized WOB based on the varying density.

26. The method of claim 25, further comprising adding impactors to the flow.

27. The method of claim 25, further comprising estimating flow density to estimate the buoyancy force.

28. The method of claim 25, wherein the step of applying the compensating force comprises a force application selected from the list consisting of decreasing the realized WOB to compensate for a decreased buoyancy force and increasing the realized WOB to compensate for an increased buoyancy force.

29. A method for controlling a force applied to a down-hole device of a material removal system, the material removal system comprising an excavating flow continuously circulating in the system in a non-static environment, the method comprising:

determining whether a change in a density of a slurry of fluid and impactors has occurred;

and controlling the force applied to the down-hole device in response to the determination that the change in the density of the slurry has occurred.

* * * * *